United States Patent [19]

Losfeld

[11] Patent Number: 4,773,330

[45] Date of Patent: Sep. 27, 1988

[54] DYNAMIC ARMED GRENADE

[76] Inventor: Christian Losfeld, 15 rue Thiébault, 94220 Charenton, France

[21] Appl. No.: 119,574

[22] Filed: Nov. 12, 1987

[30] Foreign Application Priority Data

Nov. 12, 1986 [FR] France ..... 86 15712

[51] Int. Cl.[4] ..... F42B 27/00; F42C 15/02

[52] U.S. Cl. ..... 102/487; 102/240

[58] Field of Search ..... 102/482, 486, 487, 240

[56] References Cited

U.S. PATENT DOCUMENTS 3,112,703 12/1963 Urdapilleta .

3,877,379 4/1975 Losfeld .

*Primary Examiner*—Ted L. Parr

*Attorney, Agent, or Firm*—Oblon, Fisher, Spivak, McClelland & Maier

[57] ABSTRACT

The present invention provides a grenade with dynamic arming having a body and a fuse, in which arming of the fuse is made dependent on the dynamic unwinding of a ribbon which surrounds the fuse and which is weighted with an inertia block at the end of winding, wherein said inertia weight is held in position, before the grenade is thrown, by a long safety piece, called spoon, said weight is not secured to the spoon and, at the very beginning of the trajectory of the grenade, the inertia causes both ejection of the spoon and displacement of the inertia weight, this displacement causing dynamic unwinding of the ribbon and arming of the fuse.

10 Claims, 1 Drawing Sheet

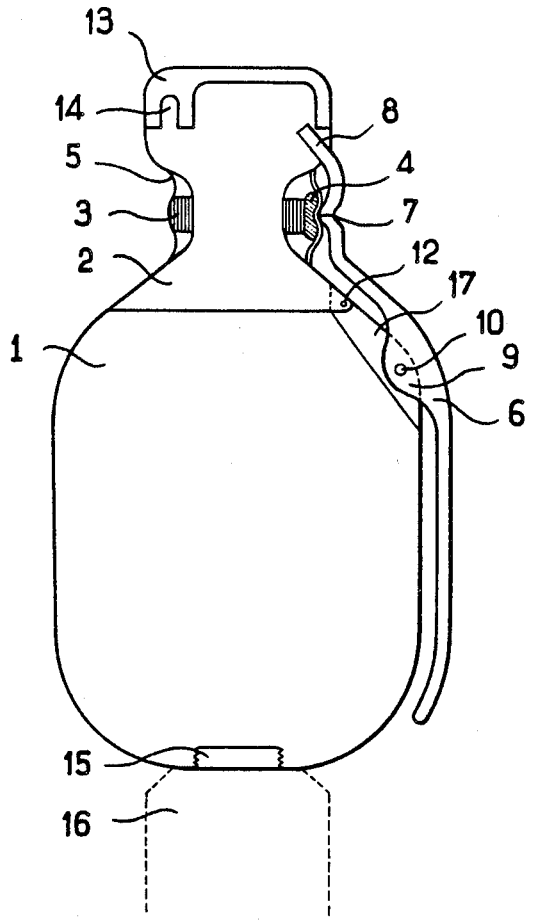
13
14
8
5
4
3
7
2
12
17
10
1
9
6
15
16

DYNAMIC ARMED GRENADE

BACKGROUND OF THE INVENTION

1. Field of the Invention

In the field of conventional infantry armement, weighted ribbons have been used for a long time which are wound around grenades and which retain a piece enabling operation: they prevent arming. When such grenades are thrown, the weighted ribbon unwinds dynamically and when the unwinding is sufficient arming takes place.

Thus such grenades remain in a safety position at the beginning of their trajectory, which prevents any premature explosion which might result either from combustion of the pyrotechnic delay which is too fast or from voluntary retention for too long of the grenade in the hand after causing firing of the fuse, or from dropping the grenade while throwing, or from the thrower falling because he is wounded by a bullet, or finally from percussion on a close obstacle of the impact fuse.

These weighted ribbons are inexpensive, and their operation is very reliable and very regular, since they do not suffer from the manufacturing defects or poor aging of all the other delay systems (pyrotechnic, clockwork, electronic etc).

2. Description of the Prior Art

However, known weight ribbon systems have drawbacks:

the cap systems, in which the inertia block is free as soon as the cap is removed, have caused undesired unwinding by mistake or through a lack of lighting, the systems in which the ribbon is attached to a spoon grip cannot be produced economically by mass production because of the complexity of their shapes and their parts (cf. French Pat. No. 1,419,979) or are too fragile and impossible to seal (cf. U.S. Pat. No. 3,112,703), the systems in which a conventional spoon has been superimposed above the weighted ribbon have proved impracticable (cf. German Pat. No. 1,099,910) because of their shapes, their complexity (numerous springs and inertia blocks) and their lack of sealing, unwinding of the ribbon being hindered in particular by the disturbing and overlong presence of the hook spoon, finally, the cap system with additional muzzling of the weighted ribbon (cf. French Pat. No. 72.31038 in the name of the applicant) presents no defect in use - it was adopted unreservedly by the French army - but the users finally preferred continuing to have a spoon grenade, so as to facilitate instruction as long as the war stock continues to include old spoon grenades, although the spoon, by itself, offers an illusory and misleading safety, which is a source of countless accidents throughout the world.

SUMMARY OF THE INVENTION

The present invention is then designed to make the movement of a spoon and the movement of the weighted ribbon compatible, mainly in a hand grenade, but also in a rifle grenade.

BRIEF DESCRIPTION OF THE DRAWINGS

The means of the invention are described hereafter in a preferred and non limitative embodiment, such as shown in the drawing.

The single FIGURE is an axial section of the external part of the grenade, the body and the fuse being simply sketched in.

DESCRIPTION OF THE PREFERRED EMBODIMENT

The grenade includes body 1 and fuse 2.

Fuse 2 is surrounded axially by a ribbon 3 which retains the arming device and which is weighted with a weight 4 at the external end of its winding. This weighted ribbon 3 and 4 is covered by a sealing elastic band 5 both of whose ends are superimposed and held in position by the pressure exerted by the safety lever 6, called spoon, bearing on the weight 4.

Spoon 6 has a protuberance 7 which compresses and immobilizes both the elastic band 5 and the weighted ribbon 3 and 4.

The upper end 8 of spoon 6 is introduced into an orifice of the fuse, and the spoon is shaped at 9 so as to be fixed by means of a known pin 10.

This pin 10 penetrates into the fixing support 11, this support being disposed slantwise at the top of body 1 of the grenade and being fixed to fuse 2 by any locking means 12: rod, key, hook, pusher, rotary bolt etc The fuse has a cap 13 for protecting the top of the fuse. This cap contains a housing 14 for a piece selecting the operating mode of the fuse. Thus, by rotating it, cap 13 may control a selector and may remain in position during throwing of the grenade.

Finally, body 1 may have axially, opposite the fuse, a means 15 for securing a tubular tail piece 16 for firing with a rifle, this tubular tail piece being slidable on the flash concealer of the rifle. This means 15 includes a removable piece which is removed to be replaced by the end of the tubular tail.

Operation

The grenade may be thrown by hand or fired from a rifle. In both cases, its operating mode (time fuse, percussion fuse, or percussion-time fuse) must be chosen, by moving the selector, which is made directly by removing the cap 13, or indirectly by rotating this latter axially.

For hand throwing it is sufficient to take the grenade in one hand, to remove pin 10 and to throw.

Through inertia, and whatever the movement of the grenade, spoon 6 moves instantly away from body 1 which frees both the elastic band 5 and the inertia weight 4. At the same time, also by inertia, the weight pushed the elastic band and the spoon before being released.

Then the spoon is ejected, the elastic band leaves the grenade and the inertia weight causes ribbon 3 to unwind, through inertia and aerodynamic braking. Once unwinding is finished, the arming device is released.

So that the unwinding is not disturbed, it is first of all necessary for the spoon to be ejected very quickly, which in particular excludes any hook shape for its end at the top, and then for the fuse to have no undesirable protuberance or hollow.

For firing from a rifle, two additional operations are required.

First of all, the finned tail piece 16 must be fixed in body 1, after removing the removable piece of the securing means 15.

Then, after fitting the grenade on the rifle, support 11 must be unlocked by releasing the locking means 12, but without removing the pin 10.

On firing, support 11 is detached slantwise from the grenade, taking spoon 6 with it and the inertia weight exerts a strong pull on the ribbon which causes the grenade to spin on the rifle and the fuse to be armed. Rotation of the grenade on the rifle ensures firing accuracy, the trajectory, because of the absence of imbalance, undergoing no deviation.

What is claimed is:

1. A grenade with dynamic arming having a body and a fuse, in which arming of the fuse is made dependent on the dynamic unwinding of a ribbon which surrounds the fuse and which is weighted with an inertia weight at the outer end of the winding, wherein said inertia weight is held in position, before the grenade is thrown, by a long safety spoon, said weight is not secured to the spoon and, at the very beginning of the trajectory of the grenade, the inertia causes both ejection of the spoon and displacement of the inertia weight, this displacement causing dynamic unwinding of the ribbon and arming of the fuse.

2. The grenade as claimed in claim 1, wherein said ribbon and its inertia wieght are covered by an elastic band, both ends of which are superimposed and are held in position by the pressure exerted by the spoon on the wieght.

3. The grenade as claimed in claim 2, wherein said spoon has a protuberance which, before the grenade is thrown, compresses and immobilizes both the elastic band and the weighted ribbon.

4. The grenade as claimed in claim 1, wherein at the beginning of the trajectory of the grenade, the spoon is detached so as not to hinder the dynamic unwinding of the weighted ribbon, whatever the movement of the grenade.

5. The grenade as claimed in claim 4, wherein at the beginning of the trajectory of the grenade, the spoon moves away from the body of the grenade through an angle less than 90° before being detached.

6. The grenade as claimed in claim 1, wherein the fuse has no shape, no protuberance and no hollow which may hinder the dynamic unwinding of the weighted ribbon, whatever the movement of the grenade.

7. The grenade as claimed in claim 1, wherein the fuse has a cap which protects the top of the fuse, above the weighted ribbon and which, by rotation, may control the operating mode of said fuse, the fuse being able to operate without the cap being removed.

8. The grenade as claimed in claim 1, wherein the fuse has a support for fixing the spoon to the grenade, this fixing support being removed at the time of throwing the grenade by hand.

9. The grenade as claimed in claim 8, wherein the fixing support is disposed slantwise on the grenade body and is detached by inertia when the grenade is fired axially by means of a firearm, the support remaining fixed to the spoon, which frees the weighted ribbon and causes it to unwind.

10. The grenade as claimed in claim 9, wherein the grenade body includes a means for fixing a piece serving for firing the grenade from a firearm.

* * * * *